US012674365B2

(12) United States Patent
Nguyen

(10) Patent No.: US 12,674,365 B2
(45) Date of Patent: Jul. 7, 2026

(54) DOWNHOLE TOOL SYSTEM, METHOD, AND BOREHOLE SYSTEM

(71) Applicant: Baker Hughes Oilfield Operations LLC, Houston, TX (US)

(72) Inventor: Tuan Nguyen, Pearland, TX (US)

(73) Assignee: Baker Hughes Holdings LLC, Houston, TX (US)

( * ) Notice: Subject to any disclaimer, the term of this patent is extended or adjusted under 35 U.S.C. 154(b) by 0 days.

(21) Appl. No.: 18/817,384

(22) Filed: Aug. 28, 2024

(65) Prior Publication Data

US 2026/0063009 A1 Mar. 5, 2026

(51) Int. Cl.

| | |
|---|---|
| ***E21B 23/01*** | (2006.01) |
| ***E21B 23/00*** | (2006.01) |
| ***E21B 29/06*** | (2006.01) |

(52) U.S. Cl.

CPC ..... *E21B 23/01* (2013.01); *E21B 23/00* (2013.01); *E21B 29/06* (2013.01)

(58) Field of Classification Search

CPC ..... E21B 23/01; E21B 23/00; E21B 29/06

See application file for complete search history.

(56) References Cited

U.S. PATENT DOCUMENTS

| | | | | |
|---|---|---|---|---|
| 1,815,672 | A * | 7/1931 | Jones | E21B 47/022 33/308 |
| 5,467,820 | A * | 11/1995 | Sieber | E21B 23/06 166/117.6 |
| 11,732,539 | B2 | 8/2023 | Nguyen | |
| 2015/0252641 | A1* | 9/2015 | Badri | E21B 23/14 166/385 |
| 2022/0025726 | A1* | 1/2022 | Langeland | E21B 27/04 |
| 2022/0364421 | A1* | 11/2022 | Nguyen | E21B 17/0465 |

* cited by examiner

*Primary Examiner* — Yong-Suk (Philip) Ro

(74) *Attorney, Agent, or Firm* — Baker Hughes Company

(57) ABSTRACT

A downhole anchor system, including a housing, a downhole force multiplier cartridge (DFMC) disposed in contact with the housing, and an anchor slip operably connected to the downhole force multiplier cartridge. A downhole system including a mill including a motive force generator, a whipstock connected to the mill, an anchor connected to the whipstock, a downhole force multiplier cartridge (DFMC) operably connected between the generator and the anchor, the DFMC multiplying a force supplied by the force generator and conveying that multiplied force to the anchor. A method for setting a downhole tool, including generating a force with a force generator, multiplying the force with a DFMC, applying the multiplied force to a settable downhole tool, and setting the tool with the multiplied force. A borehole system including a borehole, a string in the borehole, and a downhole anchor system disposed within or as a part of the string.

9 Claims, 7 Drawing Sheets

DOWNHOLE TOOL SYSTEM, METHOD, AND BOREHOLE SYSTEM

BACKGROUND

In the resource recovery and fluid sequestration industries actuations of tools is common. Many types of actuations are known to the art including hydraulic, mechanical and electrical but they often require large source generators for force to be applied. The art would benefit from possible reductions in source generator requirements.

SUMMARY

An embodiment of a downhole anchor system, including a housing, a downhole force multiplier cartridge (DFMC) disposed in contact with the housing, and an anchor slip operably connected to the downhole force multiplier cartridge.

An embodiment of a downhole system including a mill including a motive force generator, a whipstock connected to the mill, an anchor connected to the whipstock, a downhole force multiplier cartridge (DFMC) operably connected between the generator and the anchor, the DFMC multiplying a force supplied by the force generator and conveying that multiplied force to the anchor.

An embodiment of a method for setting a downhole tool, including generating a force with a force generator, multiplying the force with a downhole force multiplier cartridge (DFMC), applying the multiplied force to a settable downhole tool, and setting the tool with the multiplied force.

An embodiment of a borehole system including a borehole, a string in the borehole, and a downhole anchor system disposed within or as a part of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
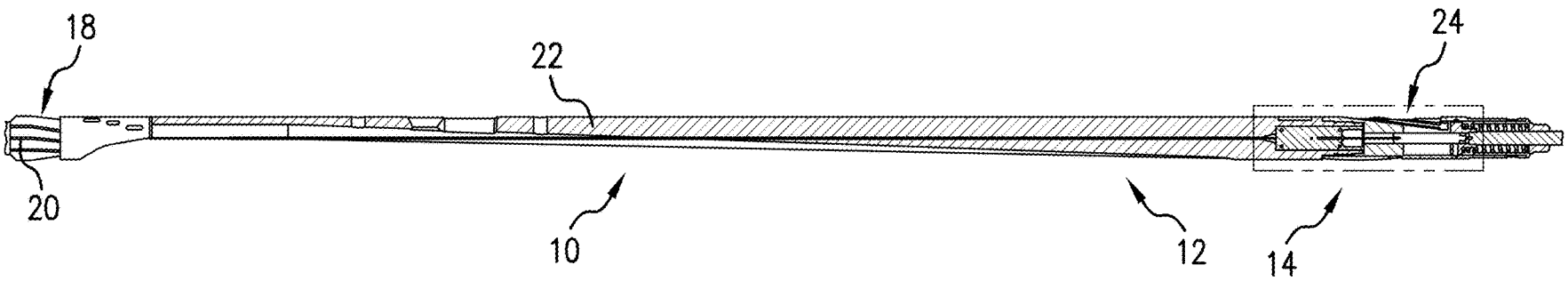
FIG. 1 is a cross-sectional view of a downhole tool system disclosed herein.

Referring to FIG. 1, a downhole tool system 10 is illustrated. The tool system 10 includes a tool 12, a settable element 14 of the tool and a downhole force multiplier (DFMC) 16 connectable between the settable element 14 and a generator of force 18. It is to be appreciated that the generator of force 18 may be located as is illustrated in the figures herein (FIG. 5) in a portion of the tool system 10 or could be more remotely located. In each case, the generator of force 18 is possibly, but not necessarily, capable of generating enough force to accomplish the setting of the settable element 14. This may occur where tool size creates a limitation of available space for a generator such as an electric motor, hydraulic piston, or mechanical generator of force, with the result that the smaller generator 18 that fits, simply may not be competent to generate enough force to accomplish the setting action required. This issue is addressed herein by the DFMC 16.

Figure 2:
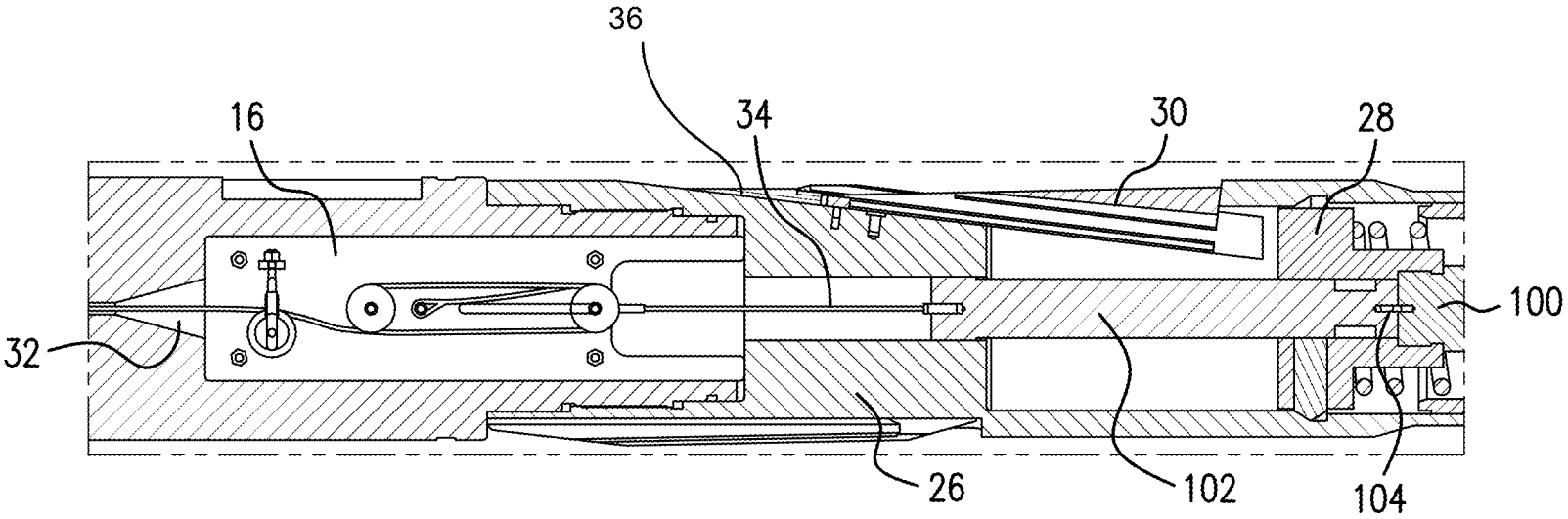
FIG. 2 is an enlarged view of a portion of FIG. 1, showing internal structure of a downhole force multiplier cartridge disclosed herein.
Figure 3:
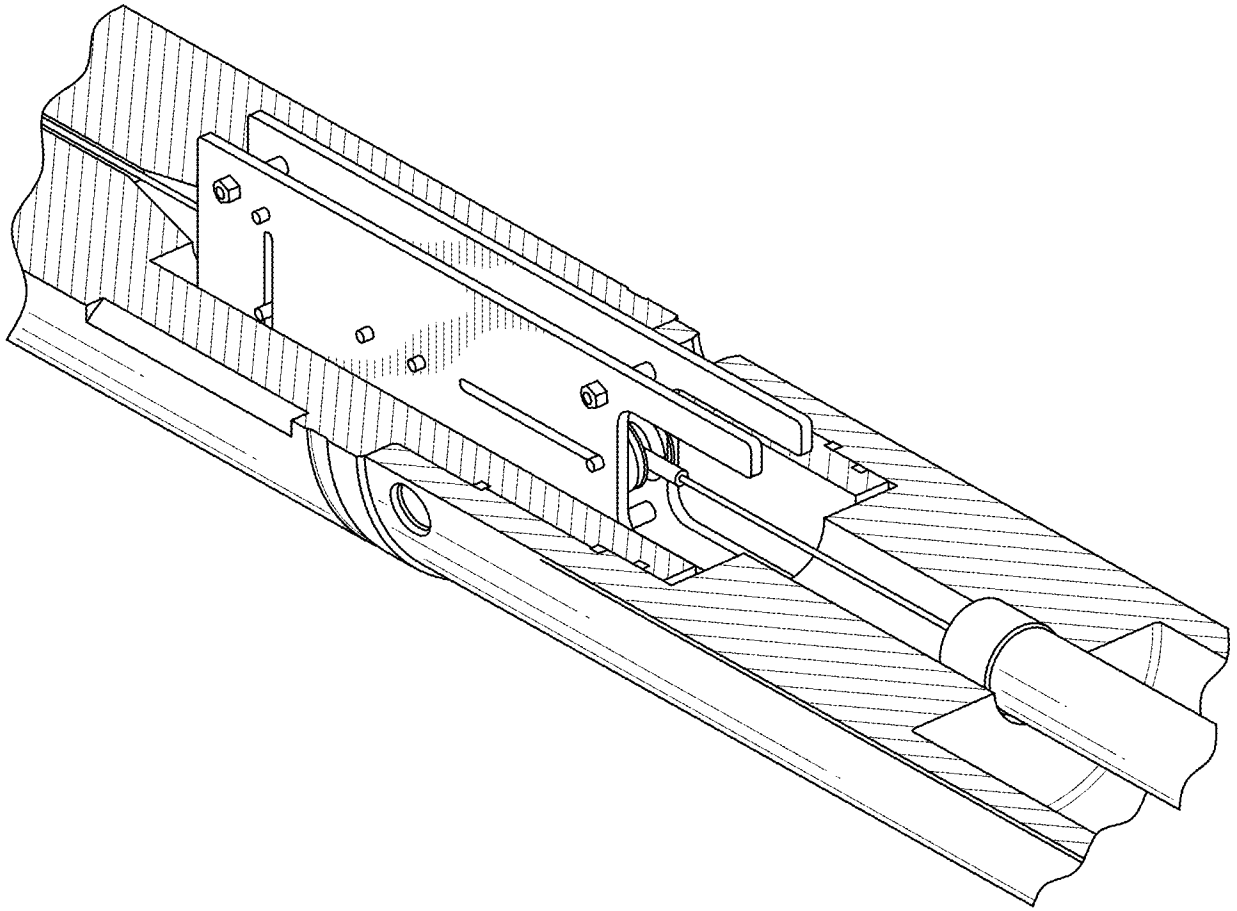
FIG. 3 is a perspective view of the same portion of FIG. 1.

Referring to FIGS. 1 and 2, one possible embodiment of the tool system 10 is illustrated. The illustrated system 10 includes a mill 20 connected to a whipstock 22. The mill 20 may include a generator 18 disposed therein (see FIG. 6, for example). Attached to the whipstock 22 is an anchor system 24 that includes a housing 26, a pusher 28, a slip 30 operably responsive to movement of the pusher 28, and the DFMC 16 operably connected between the generator 18 and the pusher 28. Initiation of force from generator 18, usually a pulling force, is conveyed through a member 32 such as a cable, rope, etc., to the DFMC 16 where that force is amplified by a pulley system and output through a tether 34, that may be a cable, rope, segment of solid material, etc. The amplified force conveyed by the tether 34 causes a release of the pusher 28 to be driven in a direction associated with causing the slip 30 to climb a ramp 36, radially outwardly displacing the slip 30. Exhaustive discussion of how the slip sets and works to anchor the system 10 is not needed as this is familiar to those of skill in the art.

Figure 4:
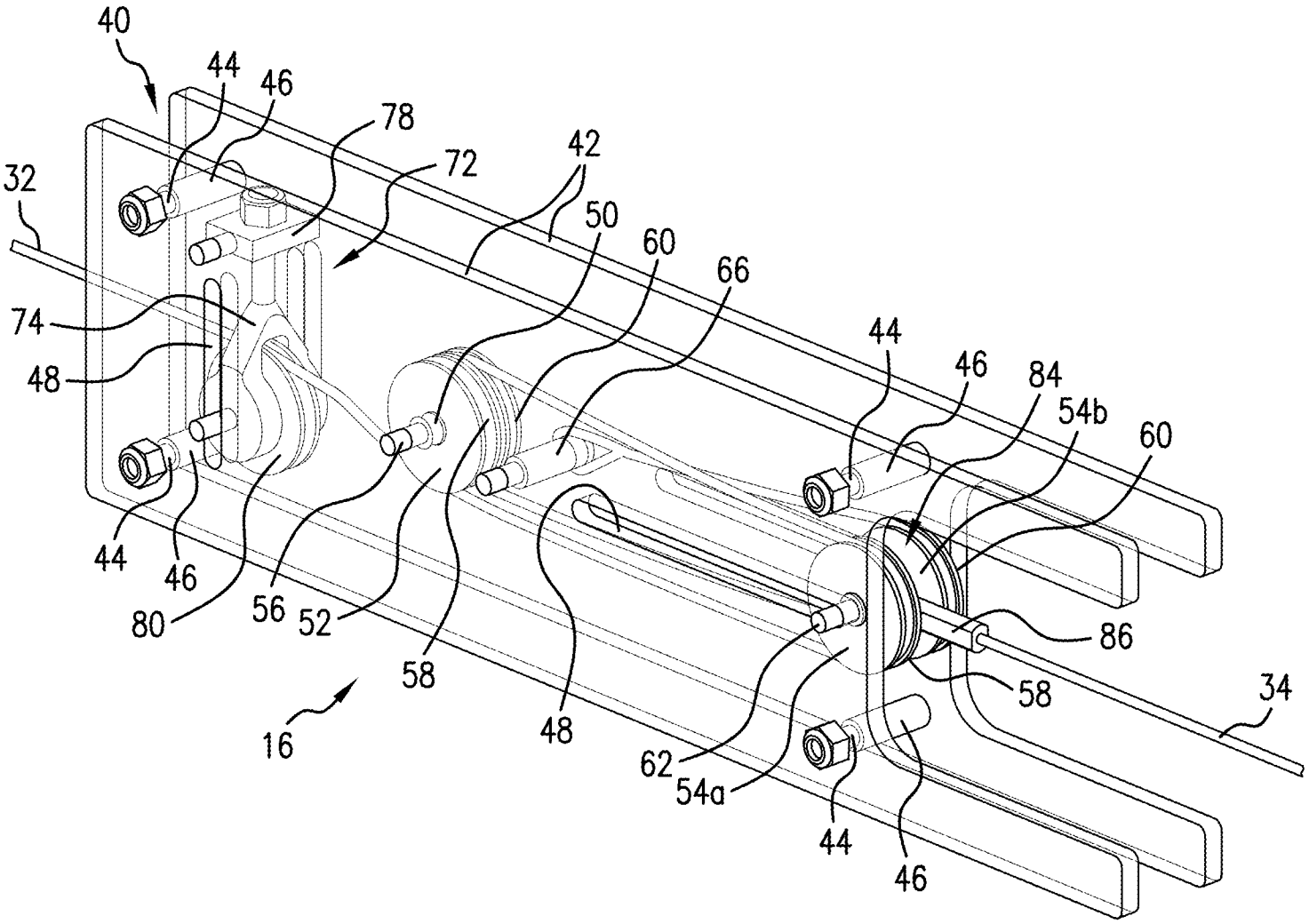
FIG. 4 is a perspective view of the downhole force multiplier cartridge by itself and with its housing transparent.
Figure 4A:
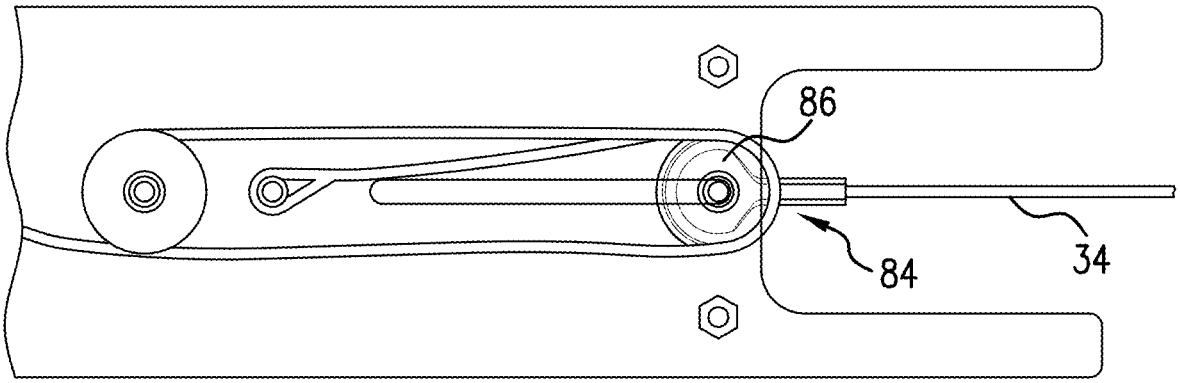
FIG. 4A illustrates in an enlarged format the tether mount visible in FIG. 4.

Referring to FIG. 4, the DFMC 16 is illustrated in detail, apart from other components of the system 10. A frame 40 is employed to locate and direct movement of the elements of DFMC 16. As illustrated the frame 40 is independent of any other components of the tool 10 but it is to be understood that the housing 26, for example, could do double duty by including features of the frame 40 so that the frame 40 itself would not be needed. Still, the frame 40 allows the DFMC 16 to actually be a cartridge that may be incorporated into a tool system simply by having a recess large enough to accommodate the DFMC 16. In any event, the illustration shows frame 40 as including two plates 42 that are joined together by fasteners 44 and spacers 46. The two plates 42 include a series of frame grooves 48 or holes 50 to either locate a pulley 52 for rotation only or to allow for one or more pulleys 54 (illustrated as two pulleys and designated 51*a* and 54*b*) to move relative to another pulley 52 with regard to distance between the two (or three as illustrated) referenced pulleys. As illustrated, there is one pulley 52 that is fixed in position (other than rotationally) on its axle 56 mounted in hole 50. Pulley 52 as illustrated includes two pulley grooves 58 and 60, but it is to be appreciated that more or fewer pulley grooves may be employed. Pulleys 54*a* and 54*b*, which include two grooves 58 and 60, respectively, as shown, are mounted on an axle 62 in a frame groove 48 that allows both rotational movement of pulleys 54 and positional movement of pulleys 54. The member 32 is illustrated fixed at fixation point 66 and wrapped around pulley 52 and 54*a* and 54*b* to create four strands 68 between the pulleys, which increases the force applied to tether 34 by four times the input from member 32. Optionally, a tensioner pulley system 72 may be employed to ensure the member 32 is not loose. System 72 includes a clevis 74 adjustably connected to a tensioner mount 78 and a tensioner pulley 80 rotatably connected to the clevis 74. Additionally included is a tether mount 84, that can be seen in in FIGS. 4 and 4A where pulley 54*a* has been rendered transparent to provide visibility to tether mount 84. The tether 34 is attachable to the tether mount 84 by swaging or other securement method and the mount 84 is attached to axle 62 by a solid or swivelable attachment 86, as illustrated or similar.

Figure 5:
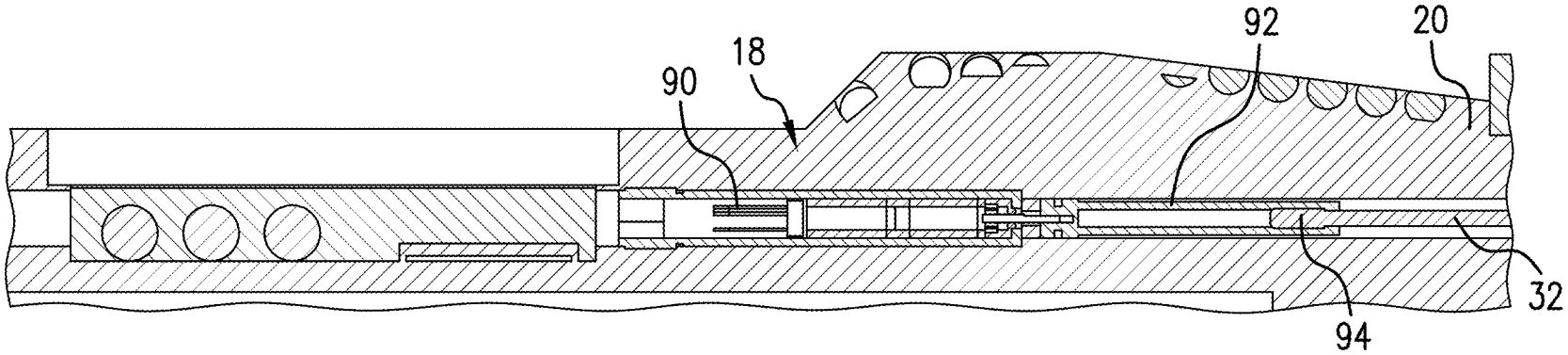
FIG. 5 is a sectional view of a mill with a motive source configuration therein and a rotary to linear movement converter.

With the understanding that the DFMC 16 can effectively increase the force provided from a generator 18 by four times, as illustrated, or my more times with additional strands between the pulleys (or less with fewer strands between the pulleys), it will be appreciated that even a smaller generator 18 such as an electric motor 90 within the mill 20 will be sufficient to set the tool system 10. One example of a generator 18 in mill 20 is illustrated in FIG. 5. In this embodiment, the motor 90 is connected to a screw-type arrangement having a female threaded rotary to linear coupler 92 which receives a male threaded member coupler 94 that in turn is connected to the member 32. Rotational movement of the motor 90 causes the coupler 94 to move along coupler 92 to pull the member 32 closer to the motor 90, thereby pulling member 32 and actuating the DFMC 16. It will be appreciated that while motor 90 is one generator 18, others are contemplated whether or not disposed directly in the mill 20.

Returning to FIG. 2, and with the understanding that the generator 18 is pulling on the DFMC 16 to create a 4× output on the tether 34, it will be appreciated that tether 34 is either directly connected to a spring lock 100 or to an actuation member 102 that is connected to the spring lock 100. Through an activation connector 104. The activation connector 104 is a defeatable member at a selected tensile load. Once the tensile load threshold is reached and the activation connector 104 releases, a power spring 106 will urge the pusher 28 toward the slip 30 and into a set position. In embodiments, the activation connector 104 may be a screw or other member capable of reliable threshold tensile failure.

Figure 6:
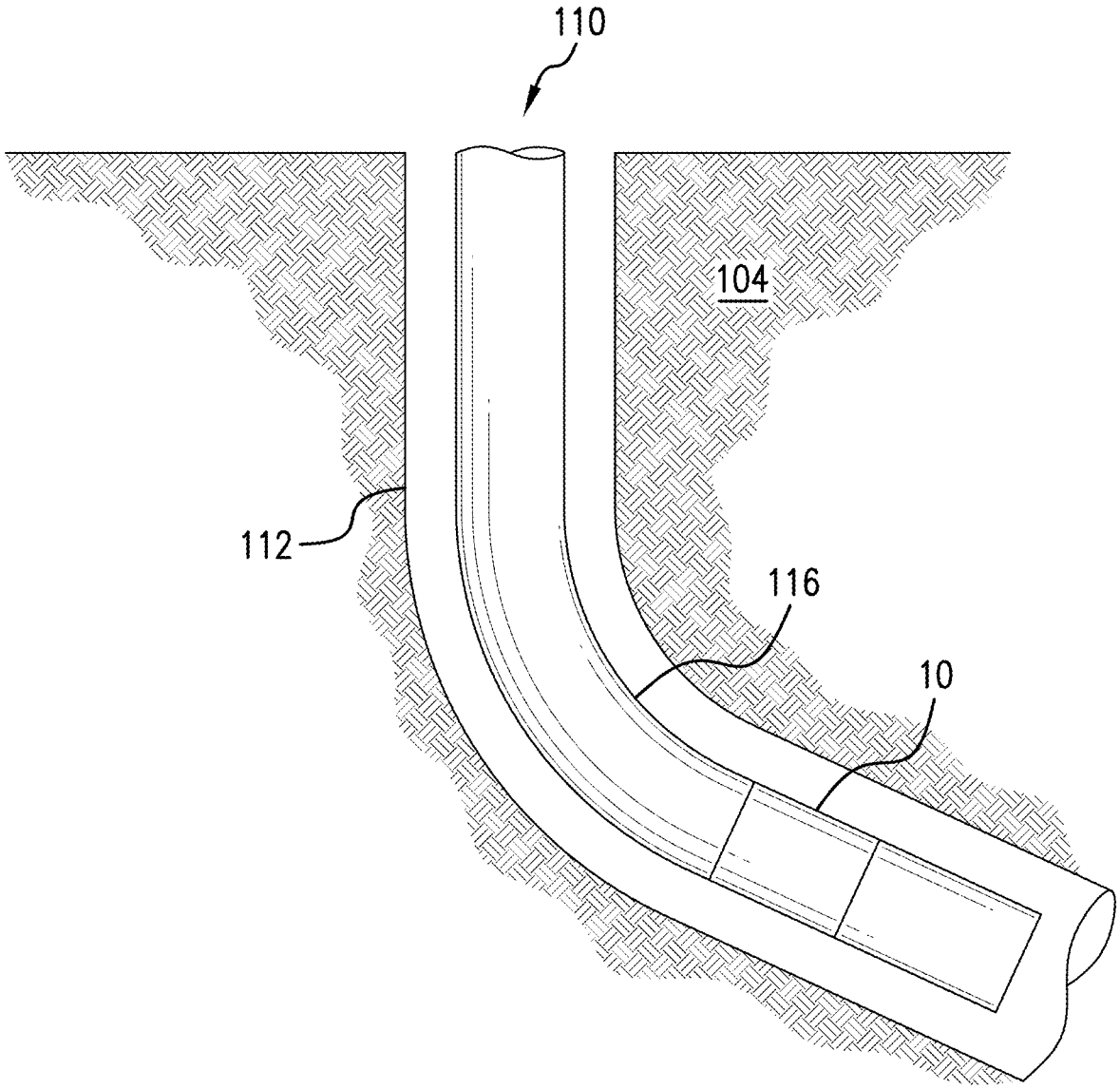
FIG. 6 is a view of a borehole system including a downhole force multiplier cartridge as disclosed herein.

Referring to FIG. 6, a borehole system 110 is illustrated. The system 110 comprises a borehole 112 in a subsurface formation 114. A string 116 is disposed within the borehole 112. A downhole tool system 10 as disclosed herein is disposed within or as a part of the string 116.

Set forth below are some embodiments of the foregoing disclosure:

Embodiment 1: A downhole anchor system, including a housing, a downhole force multiplier cartridge (DFMC) disposed in contact with the housing, and an anchor slip operably connected to the downhole force multiplier cartridge.

Embodiment 2: The system as in any prior embodiment, wherein the DFMC includes a frame, and a plurality of pulleys disposed in the frame.

Embodiment 3: The system as in any prior embodiment, wherein at least one of the pulleys of the plurality of pulleys includes more than one groove.

Embodiment 4: The system as in any prior embodiment, wherein each of the pulleys includes a rotational axis, and wherein the rotational axis of at least one of the pulleys of the plurality of pulleys is displaceable relative to the rotational axis of another of the pulleys of the plurality of pulleys.

Embodiment 5: The system as in any prior embodiment, wherein at least one of the pulleys of the plurality of pulleys includes a tether mount.

Embodiment 6: The system as in any prior embodiment, wherein the tether mount includes a swivel.

Embodiment 7: The system as in any prior embodiment, wherein the DFMC further includes a tensioner pulley.

Embodiment 8: The system as in any prior embodiment, wherein the housing incudes a whipstock.

Embodiment 9: A downhole system including a mill including a motive force generator, a whipstock connected to the mill, an anchor connected to the whipstock, a downhole force multiplier cartridge (DFMC) operably connected between the generator and the anchor, the DFMC multiplying a force supplied by the force generator and conveying that multiplied force to the anchor.

Embodiment 10: The system as in any prior embodiment, wherein the generator is an electric motor.

Embodiment 11: A method for setting a downhole tool, including generating a force with a force generator, multiplying the force with a downhole force multiplier cartridge (DFMC), applying the multiplied force to a settable downhole tool, and setting the tool with the multiplied force.

Embodiment 12: The method as in any prior embodiment, wherein the multiplying comprises rotating a plurality of pulleys.

Embodiment 13: The method as in any prior embodiment, further comprising moving at least one of the pulleys of the plurality of pulleys closer to another pulley of the plurality of pulleys.

Embodiment 14: The method as in any prior embodiment, wherein the at least one pulley that is moved closer to the another pulley includes a tether mount and the method includes transferring the multiplied force to the tether mount.

Embodiment 15: The method as in any prior embodiment, wherein the applying is through a tether disposed between the DFMC and an actuable element of the downhole tool.

Embodiment 16: A borehole system including a borehole, a string in the borehole, and a downhole anchor system as in any prior embodiment disposed within or as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A downhole anchor system, comprising:

a housing;

a downhole force multiplier cartridge (DFMC) disposed in contact with the housing, the DFMC having a force input member and a force output tether, the force input member configured to be connected to a force generator and to multiply a force generated by the force generator to be output by the force output tether; and an anchor slip operably connected to the downhole force multiplier cartridge.

2. The system as claimed in claim 1, wherein the DFMC comprises:

a frame; and a plurality of pulleys disposed in the frame.

3. The system as claimed in claim 2, wherein at least one of the pulleys of the plurality of pulleys includes more than one groove.

4. The system as claimed in claim 2, wherein each of the pulleys includes a rotational axis, and wherein the rotational axis of at least one of the pulleys of the plurality of pulleys is displaceable relative to the rotational axis of another of the pulleys of the plurality of pulleys.

5. The system as claimed in claim 2, wherein at least one of the pulleys of the plurality of pulleys includes a tether mount.

6. The system as claimed in claim 5, wherein the tether mount includes a swivel.

7. The system as claimed in claim 2, wherein the DFMC further includes a tensioner pulley.

8. The system as claimed in claim 1, wherein the housing incudes a whipstock.

9. A borehole system comprising:

a borehole;

a string in the borehole; and a downhole anchor system as claimed in claim 1 disposed within or as a part of the string.

* * * * *